US007426793B2

(12) United States Patent
Crary

(10) Patent No.: US 7,426,793 B2
(45) Date of Patent: Sep. 23, 2008

(54) FOOTWEAR SHOCK ABSORBING AND VENTILATING APPARATUS

(75) Inventor: Nathan Crary, Portland, OR (US)

(73) Assignee: LL International Shoe Co., Inc., Los Angeles, CA (US)

( * ) Notice: Subject to any disclaimer, the term of this patent is extended or adjusted under 35 U.S.C. 154(b) by 340 days.

(21) Appl. No.: 11/040,977

(22) Filed: Jan. 21, 2005

(65) Prior Publication Data

US 2005/0183286 A1 Aug. 25, 2005

Related U.S. Application Data

(60) Provisional application No. 60/538,130, filed on Jan. 21, 2004, provisional application No. 60/554,657, filed on Mar. 19, 2004.

(51) Int. Cl.
*A43B 13/20* (2006.01)

(52) U.S. Cl. ..... 36/29; 36/28; 36/114

(58) Field of Classification Search ..... 36/3 R, 36/3 B, 28, 29, 114
See application file for complete search history.

(56) References Cited

U.S. PATENT DOCUMENTS 3,027,659 A * 4/1962 Gianola ..... 36/3 R
3,128,566 A * 4/1964 Burlison et al. ..... 36/3 R
3,716,930 A * 2/1973 Brahm ..... 36/3 B
4,364,186 A * 12/1982 Fukuoka ..... 36/3 B
5,068,981 A * 12/1991 Jung ..... 36/3 R
5,224,278 A * 7/1993 Jeon ..... 36/29
5,295,313 A * 3/1994 Lee ..... 36/3 R
5,353,525 A * 10/1994 Grim ..... 36/88
5,384,977 A * 1/1995 Chee ..... 36/28
5,401,039 A * 3/1995 Wolf ..... 280/11.202
5,477,626 A * 12/1995 Kwon ..... 36/3 B
5,505,010 A * 4/1996 Fukuoka ..... 36/3 B
5,813,141 A * 9/1998 Cho ..... 36/29
5,918,381 A * 7/1999 Landry ..... 36/3 B
5,975,861 A * 11/1999 Shin et al. ..... 417/234
5,987,781 A * 11/1999 Pavesi et al. ..... 36/29
6,201,314 B1 * 3/2001 Landry ..... 290/54
6,725,571 B2 * 4/2004 Liu ..... 36/3 R
7,152,339 B2 * 12/2006 Lo ..... 36/3 R
7,171,765 B2 * 2/2007 Lo ..... 36/29
2003/0188451 A1 * 10/2003 Wu ..... 36/3 B
2004/0010939 A1 * 1/2004 Liu et al. ..... 36/29
2004/0020076 A1 * 2/2004 Liu ..... 36/3 R
2005/0005473 A1 * 1/2005 Oh ..... 36/29
2005/0097777 A1 * 5/2005 Goodwin ..... 36/29
2005/0283996 A1 * 12/2005 Soldini ..... 36/3 B

* cited by examiner

*Primary Examiner*—Marie Patterson
(74) *Attorney, Agent, or Firm*—Greer, Burns & Crain, Ltd

(57) ABSTRACT

A combination shock absorbing and ventilating apparatus for a foot bed of a shoe, comprises an air chamber having at least one flexible wall located in the foot bed of the shoe, an air intake to the air chamber, an air outlet from the air chamber, a one-way valve on at least one of the air intake or the outlet, at least one of the intake or outlet being connected to the foot bed of the shoe and operative to circulate air with the foot bed, at least one resilient member within the chamber operative to re-inflate the air chamber, and a turbine on a sidewall of the shoe, the turbine having a wheel, one of the air inlet or the air outlet being connected to the turbine for directing air flow to spin the wheel.

12 Claims, 6 Drawing Sheets

Fig. 3
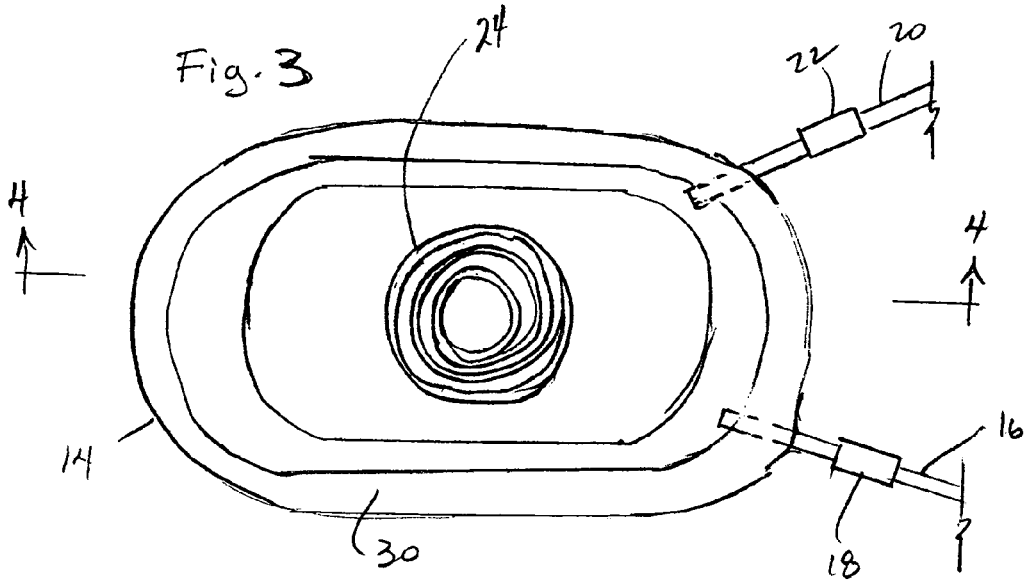
Fig. 4
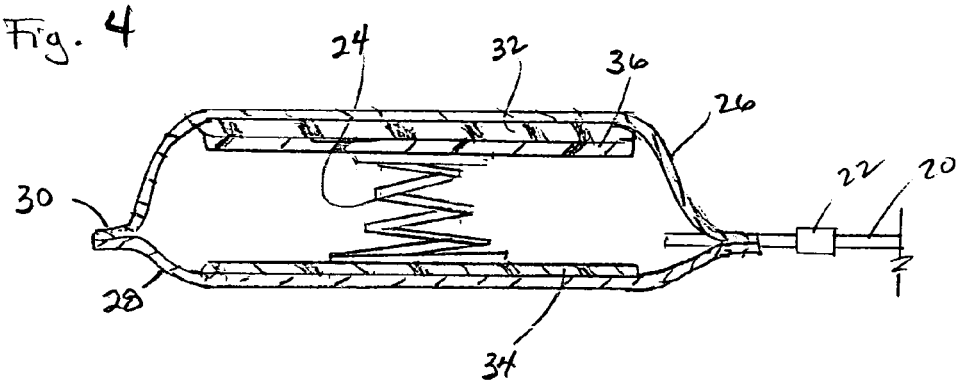
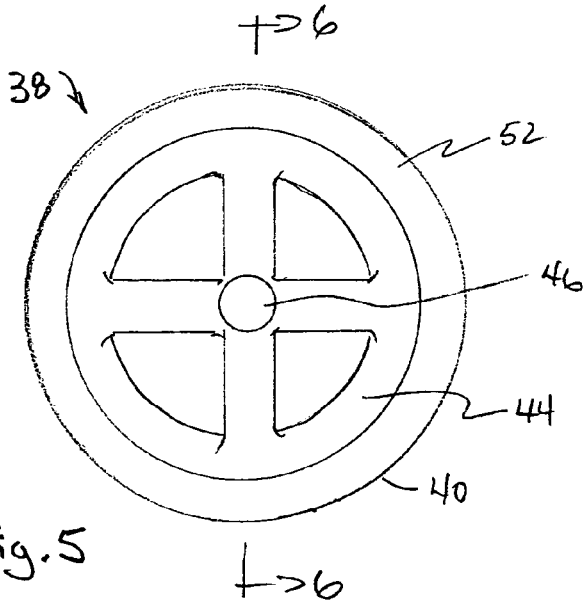
Fig. 5
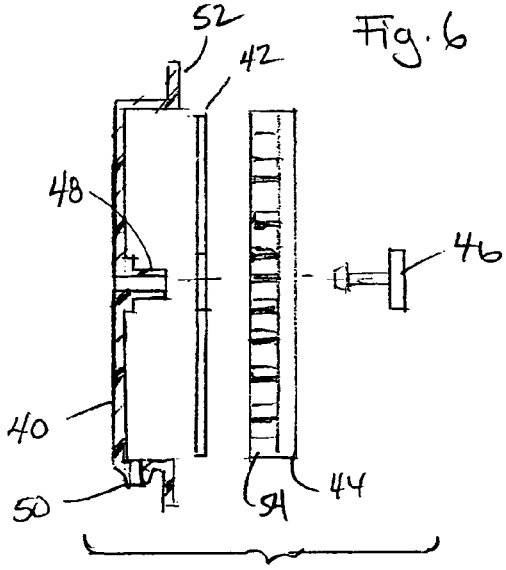
Fig. 6

FOOTWEAR SHOCK ABSORBING AND VENTILATING APPARATUS

CROSS-REFERENCE

This application claims the benefit of U.S. Provisional Patent Application No. 60/538,130 filed Jan. 21, 2004 and U.S. Provisional Patent Application No. 60/554,657 filed Mar. 19, 2004, which applications are hereby incorporated herein by reference.

FIELD OF THE INVENTION

This invention relates to shock absorbing and active heat management/moisture control apparatus for footwear.

BACKGROUND OF THE INVENTION

Various materials and devices have been developed for absorbing shock in footwear. However, such materials and devices have been entirely satisfactory. The footwear industry continues to seek improved shock absorbing and cushioning systems.

Various proposals have been made to improve ventilation in footwear. In particular, ventilation is important in athletic footwear. As with shock absorption, demand continues for improved ventilation systems.

SUMMARY OF THE INVENTION

An embodiment of the shock absorbing apparatus of the invention comprises an air chamber having at least one flexible wall located in the foot bed of a shoe, an air intake to the air chamber, a one-way valve in the intake, an outlet from the air chamber, a one-way valve in the outlet, and means to re-inflate the air chamber. The downward force of a person's weight when walking, running or jumping causes the air chamber to compress, forcing air out of the outlet. When the person lifts his/her foot, weight is removed from the air chamber, and the re-inflation means re-inflates the air chamber, drawing air in from the inlet.

Preferably the air inlet draws air from the interior of the shoe, or the air outlet expels air into the interior of the shoe to thereby circulate air within the shoe. In one embodiment air is drawn from the shoe interior thereby removing hot and/or humid air from the shoe and creating an active heat management system. It is preferred that the inlet be connected to air passages in the upper portion of the midsole, and the shoe further comprises a ventilated foot bed. Thereby air is drawn inward from the foot bed of the shoe.

Preferably, the shoe comprises a turbine assembly having a rotating wheel connected to at least one of the inlet or outlet from the air chamber. The air forced from the air chamber by the person's weight, spins the turbine wheel.

Shock absorption is accomplished in multiple ways. One, the airflow out from the air chamber is restricted. Thereby, the rate at which the air chamber compresses is controlled to provide shock absorption. Second, the re-inflation means, e.g., the spring or other resilient biasing device, provides resistance to compression of the air chamber, thereby absorbing and storing energy for re-inflation of the air chamber. Third, the outlet air is forced through a turbine providing further resistance to airflow and absorbing energy. In addition, a gel or foam pad may provide cushioning.

Another preferred feature of the invention is to locate the turbine or wheel on the exterior of the shoe, and to illuminate the same.

BRIEF DESCRIPTION OF THE DRAWINGS

FIG. 3 is a plan view of one embodiment of an air chamber of the invention.

FIG. 4 is a cross-section taken along line 4-4 of FIG. 3.

FIG. 5 is a plan view of the turbine assembly of the disclosure.

FIG. 6 is an exploded side view of the turbine assembly.

DETAILED DESCRIPTION OF PREFERRED EMBODIMENTS

Figure 1:
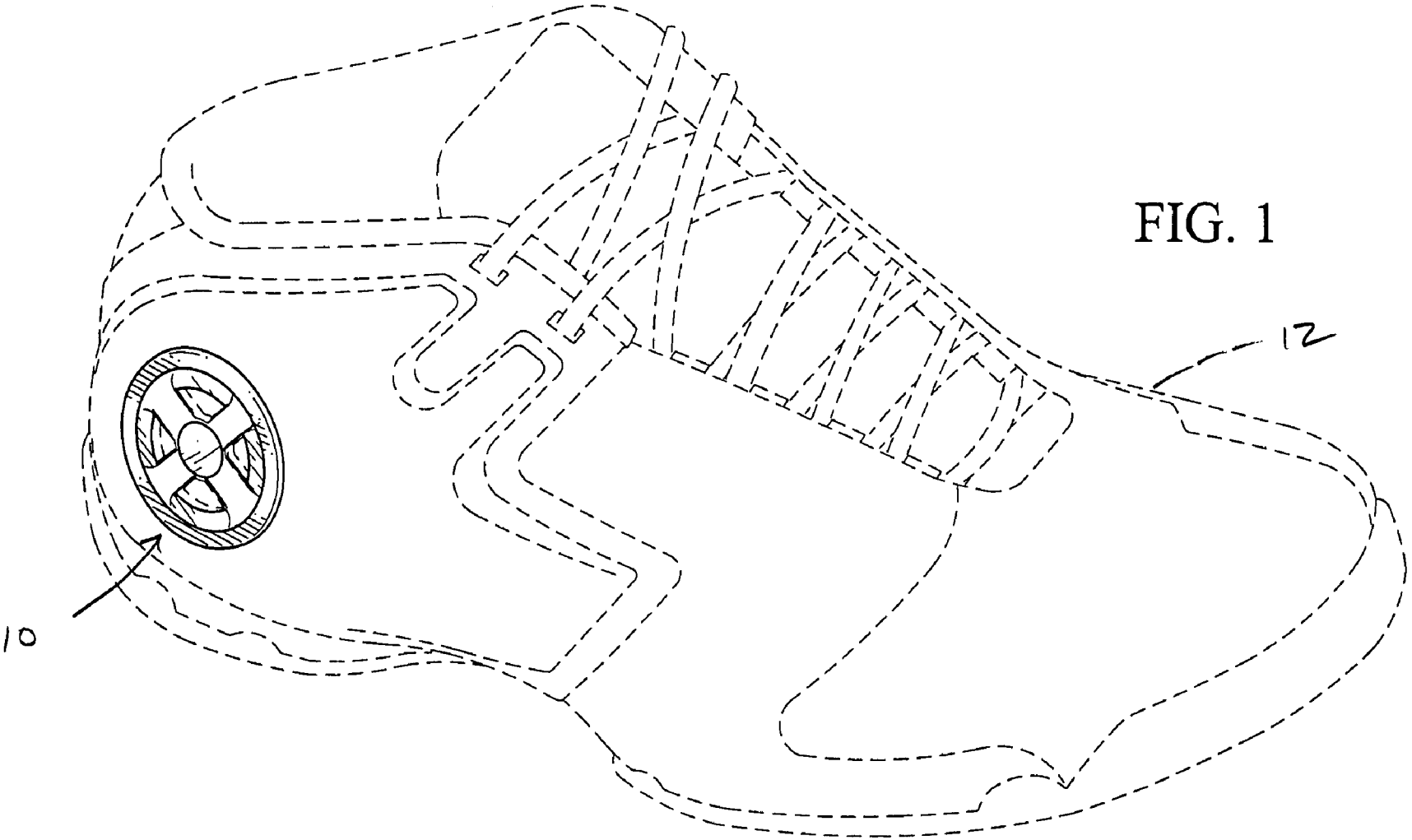
FIG. 1 is a perspective view of the turbine of the disclosure mounted on a lateral side of a shoe.
Figure 2:
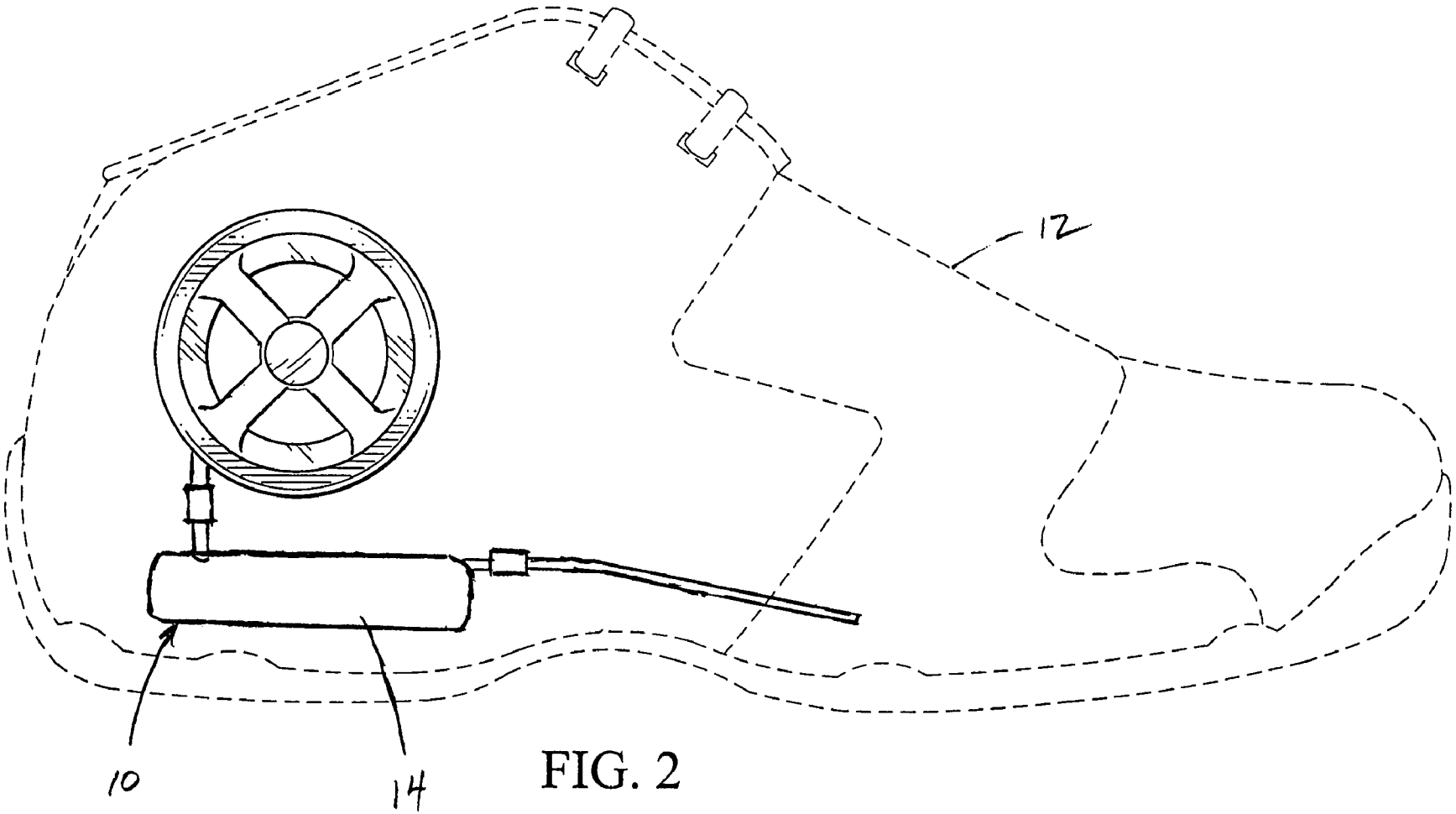
FIG. 2 is a side view of the apparatus of the invention mounted in the foot bed of the shoe.

FIGS. 1-8 show one embodiment of the shock absorbing and ventilating apparatus 10 of the invention. The apparatus is installed in shoe 12. The apparatus comprises an air chamber 14 located in the midsole of the shoe, below the wearer's heel. An air intake line 16 is connected to the air chamber. A one-way valve 18 is installed in the intake line. The one-way valve, as is well known in the art, allows air to enter into the chamber, but does not allow reverse airflow. An outlet line 20 is connected to the air chamber. A second one-way valve 22 is installed in the outlet line. The outlet valve, allows air to flow out of the intake chamber, but does not allow reverse, inward airflow. Although two one-way valves are preferred on the intake and outlet, respectively, the apparatus can operate with no valves or one valve. A spring 24 is installed within the air chamber to re-inflate the air chamber. The downward force of a person's weight when walking, running or jumping causes the air chamber to compress, forcing air out of the outlet. When the person lifts his/her foot, weight is removed from the air chamber and the spring re-inflates the air chamber, drawing air in from the inlet line.

FIG. 4 is a cross-sectional view of the air chamber 14. The air chamber preferably comprises a flexible upper shell 26 and a flexible lower shell 28. The upper and lower shells are preferably highly durable thermoplastic material. Preferably, the material is flexible, but has limited elastic properties, i.e., it does not stretch appreciably when subjected to loads during use. The shells are fused or welded together at their respective marginal edges 30 to form an airtight chamber. Inside the air chamber are a pad 32, lower plate 34, spring 24, and upper plate 36. The pad is comprised of shock absorbing material, such as TPR Supremesorb™, to provide cushioning. Plates 34,36 spread the force of the spring over a larger surface area of the shells 26,28. Spring 24 preferably comprises plural coils, e.g., a heavy coil and a light coil.

Another embodiment for shock absorption is shown in FIGS. 13-16. In this embodiment, the apparatus is comprised of an upper sheet 66, a lower sheet 68, a plurality of molded columns 70 formed from and protruding inward from sheets 66,68, an air intake 67 and an air outlet 69. The upper and lower sheets are preferably highly durable thermoplastic material. The upper sheet 66 and lower sheet 68 are fused or welded together at the tips of the columns 70, and are fused together at their respective marginal edges, forming an airtight chamber 72. Columns 70 are resilient biasing members, i.e., providing spring like qualities. When the wearer's weight compresses the chamber 72, the columns 70 collapse, thereby storing energy. Because of the durable thermoplastic material of the columns, they automatically return ("spring back") to their normal shape when the wearer's weight is removed, thus returning the energy to re-inflate the chamber 72.

Figure 17:
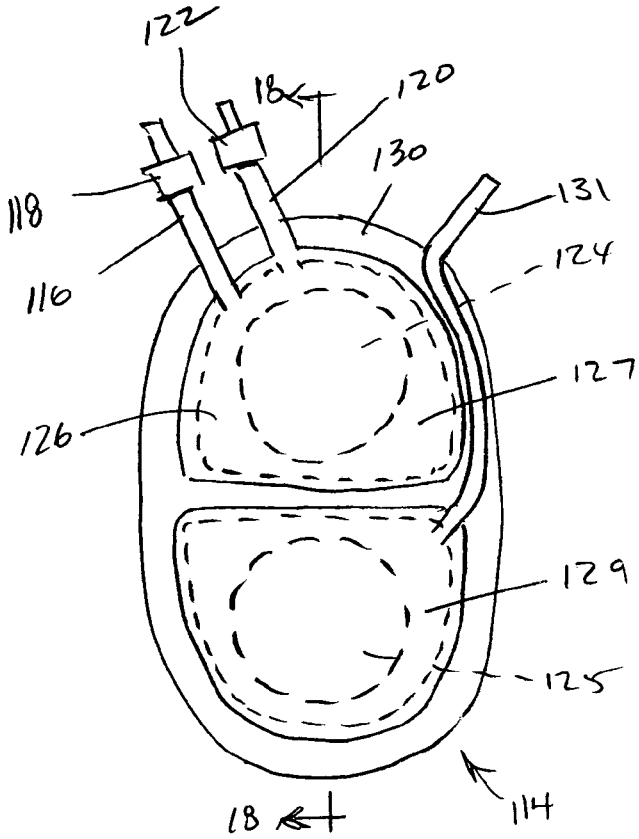
FIG. 17 is a third embodiment of the air chamber.
Figure 18:
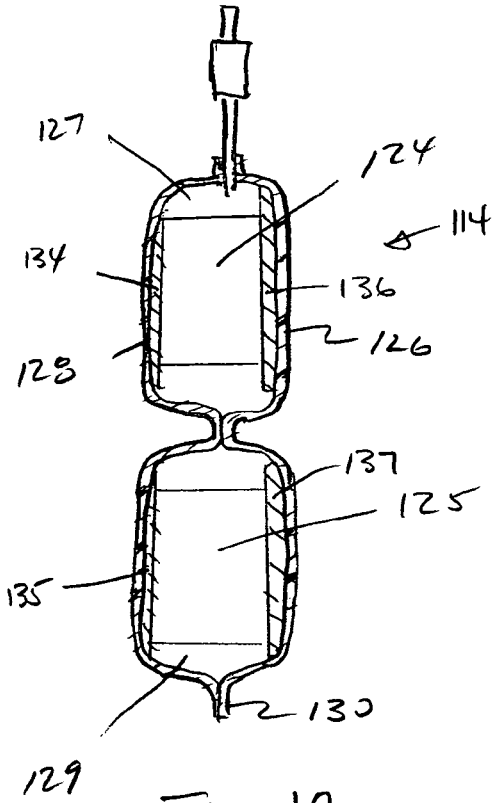
FIG. 18 is a cross section taken along line 18-18 of FIG. 17.

FIGS. 17 and 18 show a further embodiment of the air chamber 114 comprised of two compartments 127, 129. One compartment 127 performs a ventilation function while the other compartment 129 is used to drive a turbine. The air chamber preferably comprises a flexible upper shell 126 and a flexible lower shell 128. The upper and lower shells are bifurcated and fused or welded together at their respective marginal edges 130 to form two airtight compartments 127 and 129. Inside each compartment are a lower plate 134, 135 spring 124,125 and upper plate 136,137. Optionally a pad is comprised of shock absorbing material may be provided. An air intake line 16 is connected to the air chamber. A one-way valve 118 is installed in the intake line 116 to compartment 127. An outlet line 120 is connected to the compartment 127. A second one-way valve 122 is installed in the outlet line. One of the intake or outlet lines are connected to the inside of the shoe (preferably the inlet) and the other line is connected to exterior of the shoe (preferably the outlet). Thereby compartment 127 functions to ventilate the shoe. The remaining line 131 is connects the compartment 129 with the turbine. The line 131 does not have a one-way valve, thus it draws air into and expels air from compartment 129 to drive the turbine wheel as further explained below.

FIGS. 5 and 6 show one embodiment of the air turbine assembly 38. The turbine assembly comprises a housing 40, optional disk 42, wheel 44 and hub 46. The housing includes a spindle 48, one or more ports 50, and outer flange 52. The flange can be molded with a black resin (or painted black) to represent an automobile tire. It is not necessary for the housing 40 to be an enclosed structure as seen in FIG. 6. Rather, it is contemplated in another embodiment that the housing comprise an open frame for mounting one or more ports 50, and the outer flange 52. An open frame housing would allow air to flow more freely through the housing 40.

The wheel 44 is mounted for rotation on the spindle 48 and held in place with the hub 46. The outlet airline 16 is adapted for connection to port 50. Port 50 is set at an angle to direct the air in an at least partly tangential direction relative to the wheel 44. Wheel 44 has a multiplicity of fins or blades 54. Air directed against the blades causes the wheel to rotate. Although a multiplicity of blades is shown, the invention is not limited to any number or shape of blades. It is contemplated in another embodiment that fewer blades will operate more efficiently, increasing the speed at which the wheel 44 spins and also reducing noise. Desirably, the housing has two ports, one for use on the left shoe and the other for use on the right shoe, to thereby rotate both wheels in a forward direction. The optional plate 42 is largely decorative. For example, the plate 42 may be chrome or have a high gloss finish. Alternatively, the disk may be phosphorescent. In one embodiment the disk is an electrically powered light emitting material, such as a light emitting diode.

Another embodiment of the air turbine or wheel assembly includes a clear plastic cover 64, seen in FIGS. 9-12. The cover 64 is placed over the wheel 44 and is attached to the wheel assembly 38 by the hub 46. The cover 64 has a bulbous shape, which causes the wheel 44 to rotate at a greater speed. After the air is directed against the blades, it rises to the surface of the cover 64, remaining within the wheel assembly, forming a whirlpool of air. The continuous circular movement of the air will catch blades 54 and outer edges of spokes 55, causing the wheel to continue spinning. Because the air is trapped within the cover 64 and has not escaped to the atmosphere, wheel 44 spins at a greater speed and/or duration. To reduce fogging of the cover due to moist, trapped air, it is desirable to vent the housing 40 out to the atmosphere. In addition or alternatively, the cover can be provided with an anti-fog coating.

Figure 7:
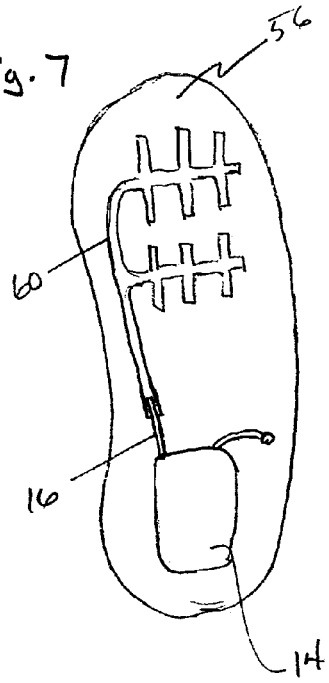
FIG. 7 is a plan view of a foot bed of the shoe.
Figure 8:
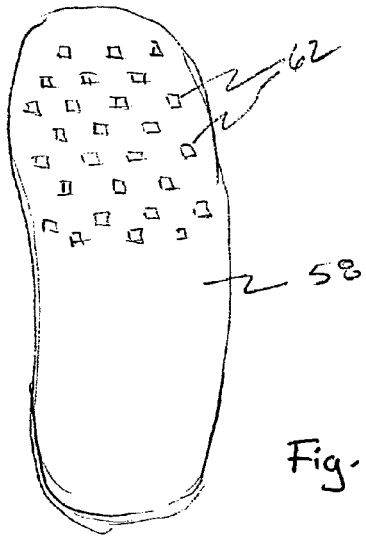
FIG. 8 is a plan view of one embodiment of a sock liner of the shoe.
Figure 11:
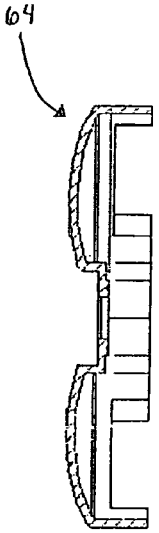
FIG. 11 is a cross-section taken along line 11-11 of FIG. 9.
Figure 10:
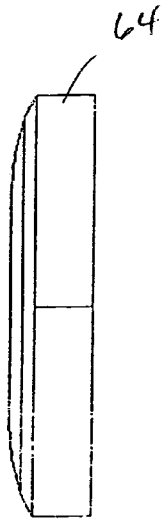
FIG. 10 is a side view of the cover.
Figure 9:
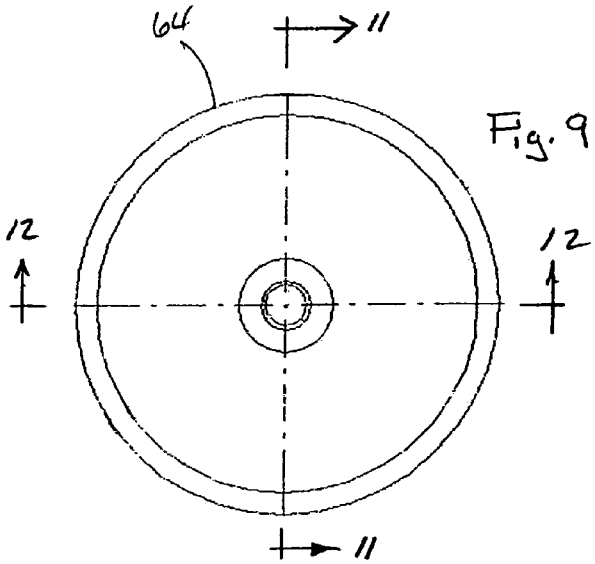
FIG. 9 is a plan view of a cover for the turbine assembly.
Figure 12:
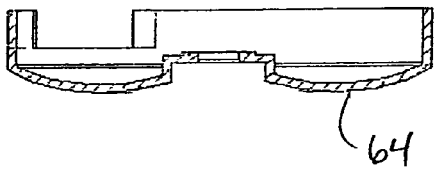
FIG. 12 is a cross-section taken along line 13-13 of FIG. 9.
Figure 13:
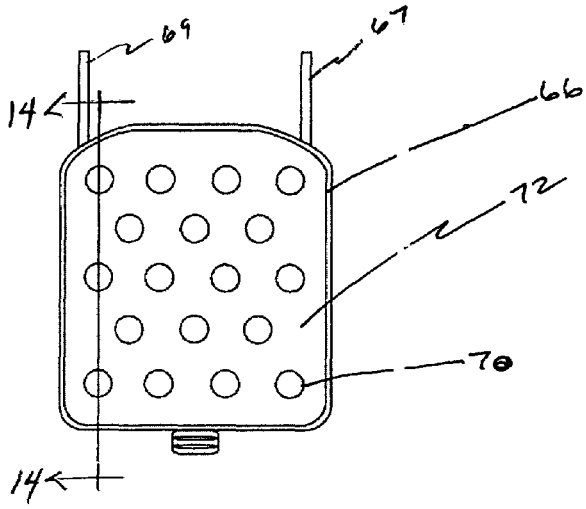
FIG. 13 is a plan view of a second embodiment of the air chamber component of the apparatus of the disclosure.
Figure 14:
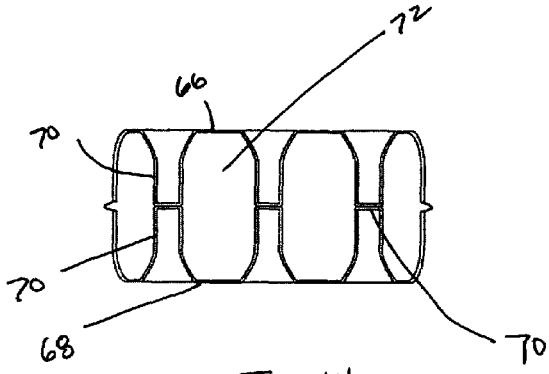
FIG. 14 is cross-section taken along line 15-15 of FIG. 14.
Figure 15:
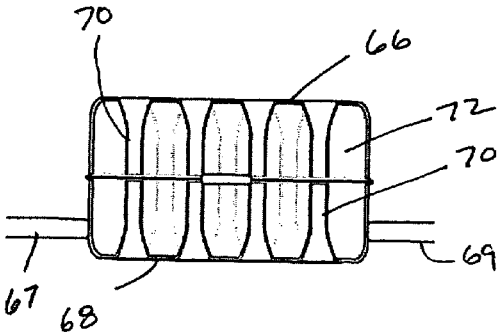
FIG. 15 is a front view of the second embodiment of the air chamber.
Figure 16:
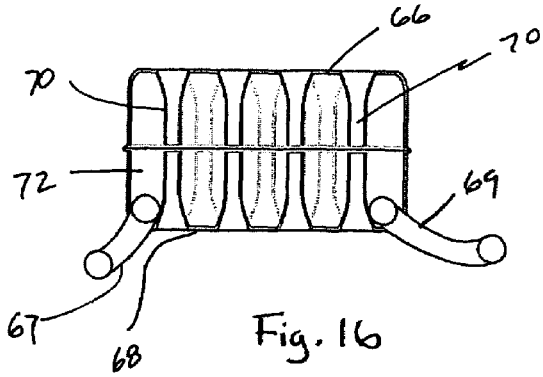
FIG. 16 is a rear view of the second embodiment of the air chamber.

FIGS. 7 and 8 are plan views of one embodiment of the top of the midsole 56 of shoe 12 and insole or sock liner 58, respectively. Preferably, the inlet tube 16 (or outlet tube 20) to air chamber 14 is connected to a pattern of channels 60 in the top of midsole 56. The insole 58 is provided with a pattern of openings 62 in communication with channels 60. Thereby, air is drawn from the planter surface of the wearer's foot, through the insole, channels, inlet tube and into the air chamber. Accordingly, an active heat management system is created, and the wearer's foot is ventilated.

The apparatus of this embodiment provides shock absorption in several ways. One, the air chamber provides shock absorption when the wearer applies load to the chamber. Air is released from the air chamber at a controlled and restricted rate. Specifically, the outlet tube has a relatively small diameter, e.g., 2 mm internal diameter, thereby allowing a limited flow. Additional energy is dissipated in the one-way valve, where the flow path is further restricted, e.g., 1 mm. Further flow restriction may be provided at the port into the housing, e.g., 0.5 mm. The restricted outflow provides shock absorption.

Second, energy is stored in spring 24 or other biasing means when the wearer's weight compresses the air chamber, which energy is returned to re-inflate the air chamber when the wearer's weight is removed.

Third, the wheel provides further shock absorption, as energy is required to spin the wheel 44. The relative amount of shock absorption can be controlled by increasing the size and/or weight of the wheel, or by adjusting the amount of rotational friction between the wheel and housing.

While the preferred embodiments of the present invention have been shown and described, it is to be understood that these are merely examples for practicing the invention that the inventor foresees at the present time, and that various modifications and changes could be made thereto. In particular, various other spinning wheel assemblies could be designed by persons skilled in the art; and different passageways could be designed for ventilating the shoe.

What is claimed is:

1. A shock absorbing apparatus for a shoe, comprising an air chamber having at least one flexible wall located in the shoe, an air intake to said air chamber, an air outlet from said air chamber, a plurality of resilient columns within said air chamber for re-inflating said air chamber, and a turbine on said shoe, said turbine being operatively connected to at least one of said air inlet or said air outlet.

2. A shock absorbing apparatus as in claim 1, further comprising a one-way valve on at least one of said air intake or said outlet.

3. A shock absorbing apparatus as in claim 1, having a one-way valve on said air intake and a second one-way valve on said air outlet.

4. A shock absorbing apparatus as in claim 1 wherein at least one of said air intake or said air outlet are connected to the interior of the shoe to circulate air within said shoe.

5. A shock absorbing apparatus as in claim 4, wherein said air intake draws air in from outside of said shoe, and said air outlet expels air into a foot bed of said shoe.

6. A shock absorbing apparatus as in claim 1 wherein said turbine comprises a housing, a spindle on the housing, a wheel mounted for rotation on said spindle, said wheel having a plurality of blades, one of said air inlet or said air outlet being connected to said housing for directing air flow against said blades.

7. A shock absorbing apparatus as in claim 1 further comprising a translucent, bulbous-shaped cover on said turbine operatively adapted to confine and channel a whirlpool of air within said turbine.

8. A combination shock absorbing and ventilating apparatus for a foot bed of a shoe, comprising an air chamber having at least one flexible wall located in the foot bed of the shoe, an air intake to said air chamber, an air outlet from said air chamber, a one-way valve on at least one of said air intake or said outlet, at least one of said intake or outlet being connected to said interior portion of the shoe and operative to circulate air within the shoe, and at least one springless resilient member within said chamber operative to re-inflate said air chamber, and a turbine on a sidewall of the shoe, said turbine having a wheel, one of said air inlet or said air outlet being connected to said turbine for directing air flow to spin said wheel.

9. A shock absorbing and ventilating apparatus as in 12 wherein said air intake is connected to said turbine to draw air through said turbine and spin said wheel, and said air outlet is connected to the foot bed of said shoe to force air into said foot bed to ventilate the foot bed and the interior of the shoe.

10. A shock absorbing apparatus for a foot bed of a shoe, comprising an air chamber having at least one flexible wall located in the foot bed of the shoe, an air intake to said air chamber, an air outlet from said air chamber, a one-way valve on at least one of said air intake or said outlet, a turbine on a sidewall of the shoe, said turbine having a wheel, one of said air inlet or said air outlet being connected to said turbine for directing air flow to spin said wheel, and at least one resilient member within said chamber operative to re-inflate said air chamber.

11. A shock absorbing apparatus as in claim 10 wherein the turbine comprises a housing having a flange and said wheel is mounted for rotation in said housing.

12. A shock absorbing apparatus for a shoe, comprising an air chamber having at least one flexible wall located in the shoe, an air intake to said air chamber, an air outlet from said air chamber, means to re-inflate said air chamber, a turbine on said shoe, said turbine being operatively connected to at least one of said air inlet or said air outlet, and a translucent cover on said turbine operatively adapted to confine and channel a whirlpool of air within said turbine.

* * * * *